US005897037A

United States Patent [19]

Mann

[11] Patent Number: 5,897,037

[45] Date of Patent: Apr. 27, 1999

[54] COMBINATION CAP AND DISPENSING SPOUT ASSEMBLY

[76] Inventor: Paul A. Mann, 1709 Rush Ave., Vista, Calif. 92084

[21] Appl. No.: 08/871,547

[22] Filed: Jun. 9, 1997

[51] Int. Cl.[6] ..... B67D 3/00

[52] U.S. Cl. ..... 222/519; 222/549; 222/552

[58] Field of Search ..... 222/519, 520, 222/548, 549, 551, 557, 570

[56] References Cited

U.S. PATENT DOCUMENTS

| | | | |
|---|---|---|---|
| 3,121,519 | 2/1964 | Cherba | 222/519 |
| 3,184,091 | 5/1965 | Hoffman | 222/552 |
| 4,494,682 | 1/1985 | Beckstrom et al. | 222/570 |
| 4,771,923 | 9/1988 | Zinnbauer | 222/519 |
| 5,071,042 | 12/1991 | Esposito | 222/570 |

*Primary Examiner*—Joseph A. Kaufman

*Attorney, Agent, or Firm*—Charles C. Logan, II

[57] ABSTRACT

A combination cap and dispensing spout assembly for a carbonated beverage bottle. It is designed to stay on the beverage bottle until it is empty. It is pressed onto the original sealing cap of the carbonated beverage bottle and it is detachably snapped over the annular shoulder on the neck of the bottle. When it is desired to dispense some of the beverage, the bottle is turned upside down and the combination cap and dispensing spout assembly is rotated about ¼–¾ of a turn which allows the carbonated beverage to pour out of the tubular spout of the combination cap and dispensing spout assembly. The carbonated gas that has escaped from the liquid beverage cannot readily escape from the carbonated beverage bottle but instead rises into the space above the liquid beverage in the bottles upside down position. When the desired amount of carbonated beverage has been poured, the combination cap and dispensing spout assembly is rotated back to its original sealing position and the beverage bottle is returned to its upright position.

10 Claims, 1 Drawing Sheet

COMBINATION CAP AND DISPENSING SPOUT ASSEMBLY

BACKGROUND OF THE INVENTION

The invention relates to plastic carbonated beverage bottle and more specifically to a combination cap and dispensing spout assembly that is detachably secured to the top end of the carbonated beverage bottle.

Presently when a person wishes to pour some of the carbonated beverage from a plastic carbonated beverage bottle, the bottle is in its upright position and the original cap is unscrewed and taken off the top of a bottle. This allows some of the carbonated gases in the beverage to escape into the atmosphere prior to drinking from the bottle or pouring some of the carbonated beverage into a glass. The longer the top of the bottle remains uncovered, the more carbonated gas that is allowed to escape. With bottles in 1 and 2 liter sizes, it is rare that all of the carbonated beverage is consumed or poured at one time. Usually the cap is replaced on the top of the bottle. Every time the bottle cap is removed and more beverage consumed, additional carbonated gas escapes into the atmosphere and the beverage develops a flat taste.

It is an object of the invention to provide a novel combination cap and dispensing spout assembly that can be quickly and easily attached to and detached from the cap of a plastic carbonated beverage bottle.

It is also an object of the invention to provide a novel cap and dispensing spout assembly that is economical to manufacture and market.

It is another object of the invention to provide a novel cap and dispensing spout assembly that can be removed from the carbonated beverage bottle and reused on other carbonated beverage bottles.

It is an additional object of the invention to provide a novel combination cap and dispensing spout assembly that will minimize the amount of carbonated gas that is allowed to escape each time some of the carbonated beverage is poured from the bottle.

SUMMARY OF THE INVENTION

The combination cap and dispensing spout assembly is used on plastic bottles of carbonated beverages such as cola, root beer, club soda, etc. Use of the device allows for partial removal of liquid from the plastic bottle without removing the original cap and also preventing carbonated gas in the beverage from freely escaping. When the device is used, the bottle may be used for one or more glasses of beverage at-a-time and the remaining liquid beverage in the bottle remains pressurized and is still fresh days or weeks later. The combination cap and dispensing spout assembly is especially beneficial when soft drinks are purchased in the 2 liter size.

In use, the combination cap and dispensing spout assembly is placed on the capped carbonated beverage bottle. With a slight downward pressure, the device will lock on the annular neck collar of the bottle and form a fluid-tight seal. The combination cap and dispensing spout assembly has an elongated tubular body and an elongated tubular spout. The interior of the tubular body has knurled axial ridges that frictionally engage the knurled axial ridges of the cap of the carbonated beverage bottle. To pour some of the liquid beverage, it is simply necessary to turn the bottle upside down so that liquid fills the bottle neck and with the tubular spout over a receiving container. Next the combination cap and dispensing spout assembly is rotated ¼–¾ turn. The carbonated beverage will now flow out through the internal threads of the bottle cap that has been loosened and out through the tubular pouring spout. To stop the flow of carbonated beverage, simply re-tighten the bottle cap by rotating the combination cap and dispensing spout assembly back to its original position.

The carbonated beverage bottle should always be inverted when the cap is opened, thereby keeping the liquid in the bottle neck and also preventing the escape of the carbonated pressurizing gas. To remove the combination cap and dispensing spout assembly, it is merely necessary to unscrew it a full turn. This will raise the bottle cap far enough along the threads of the neck of the carbonated beverage bottle to lift the combination cap and dispensing spout assembly up and disengage it from the annular collar of the beverage bottle. At this point, the combination cap and dispensing spout assembly can be easily lifted off of the bottle without any effort.

DESCRIPTION OF THE PREFERRED EMBODIMENT

Figure 1:
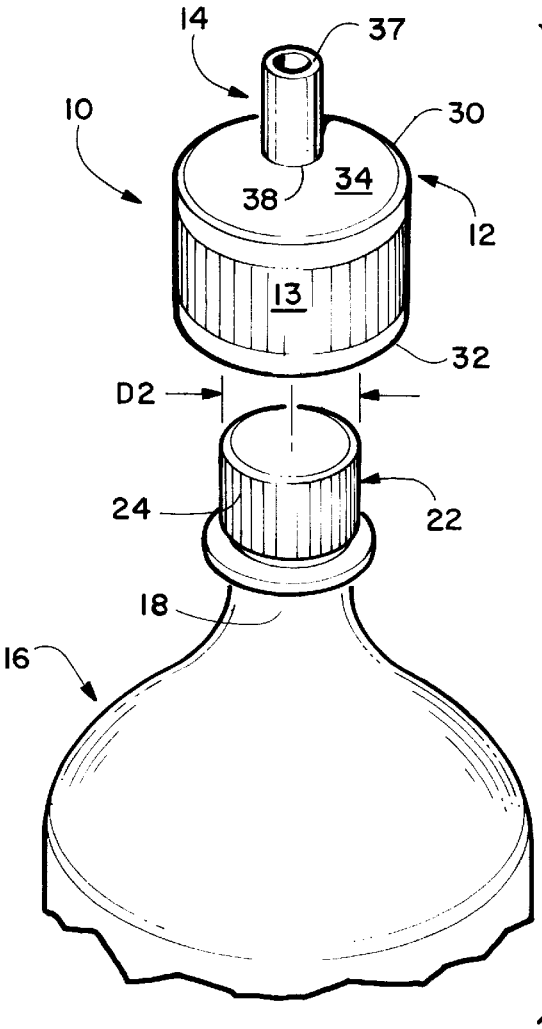
FIG. 1 is an exploded front elevation view of the combination cap and dispensing spout assembly and its relationship to a carbonated beverage bottle.

A novel combination cap and dispensing spout assembly for carbonated beverage bottles will now be described by referring to FIGS. 1–4 of the drawing. The combination cap and dispensing spout assembly is generally designated numeral 10. It has a tubular body 12 and a tubular spout 14.

A conventional plastic carbonated beverage container 16 is illustrated in FIG. 1. It has a neck portion 18 having an annular collar or shoulder 20 formed thereon. The original sealing cap 22 has knurled axial ridges 24 on its outer surface. Cap 22 has a diameter D2 and it is threaded on the external grooves adjacent the top end of neck portion 18.

Combination cap and dispensing spout assembly 10 is preferably made of plastic material. Its tubular body 12 has a top end 30 and a bottom end 32. Tubular body 12 has a top wall 34 having an outlet port 35. Tubular spout 14 has a top edge 37 and a bottom edge 38. Bottom edge 38 is connected to top wall 34 and surrounds outlet port 35. The bottom surface of top wall 34 has a plurality of radial grooves 40 that communicate with outlet port 35 and the bore of tubular spout 14.

The bottom end 32 of tubular body 12 has an inner diameter D1 that is approximately 0.005th of an inch smaller than the outer diameter D2 of ceiling cap 32. An annular groove 42 is formed a predetermined distance inwardly from bottom edge 32 for removably capturing annular collar 20 of carbonated beverage bottle 16. A plurality of relieved channels 44 extend axially inwardly from bottom edge 32 to annular groove 42. These relieved channels allow the bottom end of tubular body 12 to flex outwardly over annular collar 20 as the combination cap and dispensing spout assembly 10 is pushed downward onto the top of sealing cap 22 of bottle 16. Once the annular collar 20 has traveled a proper distance upwardly into the bottom end 32 of tubular body 12, tubular body 12 will snap over annular collar 20 as it travels into annular groove 42. An annular shoulder 46 is also provided adjacent the bottom end 32 of tubular body 12 and a gasket 48 is positioned against it. The annular collar 20 of the beverage bottle 16 is pressed into sealing engagement with gasket 48 to prevent any escape of fluid therebetween.

On the interior surface of tubular body 12 are formed knurled axial ridges 50 that engage the knurled axial ridges 24 of sealing cap 22. This is a friction fit such that when tubular body 12 is rotated, sealing cap 22 will also rotate as a single unit. A plurality of axial grooves 52 provide a liquid passage way for the carbonated beverage to travel between the outer surface of sealing cap 22 and the inner surface of tubular body 12.

Figure 2:
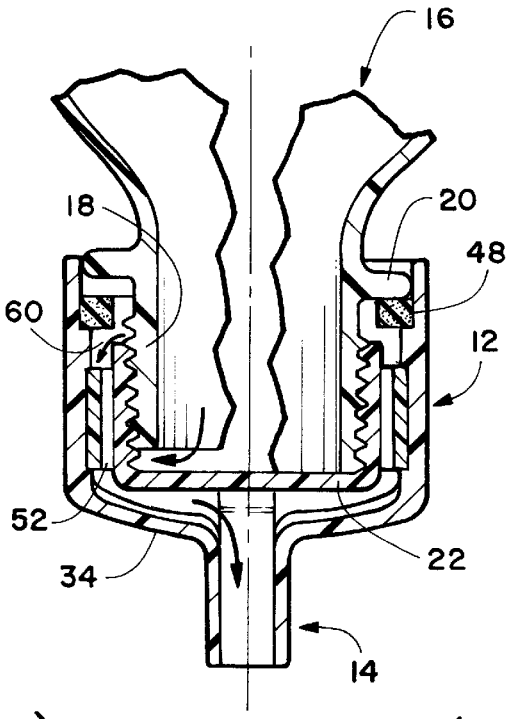
FIG. 2 is a cross sectional elevation view showing the combination cap and dispensing spout assembly captured on the top end of a carbonated beverage bottle that has been turned upside down; the right half of FIG. 2 illustrates the structure of the combination cap and dispensing spout in the sealed state when no liquid carbonated beverage can be poured and the left side of FIG. 2 illustrates the dispensing state when liquid carbonated beverage is allowed to be poured out of the tubular spout.
Figure 4:
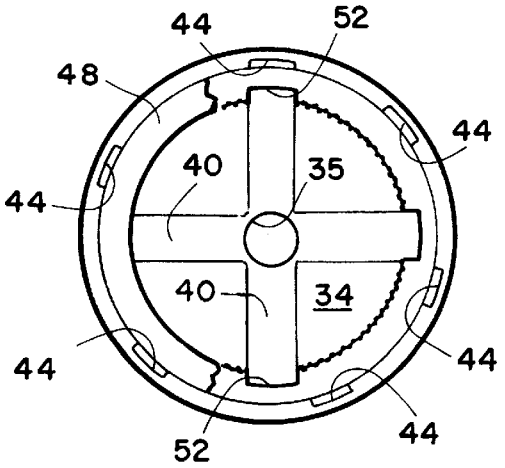
FIG. 4 is a bottom elevation view of the combination cap and dispensing spout assembly with portions broken away.
Figure 3:
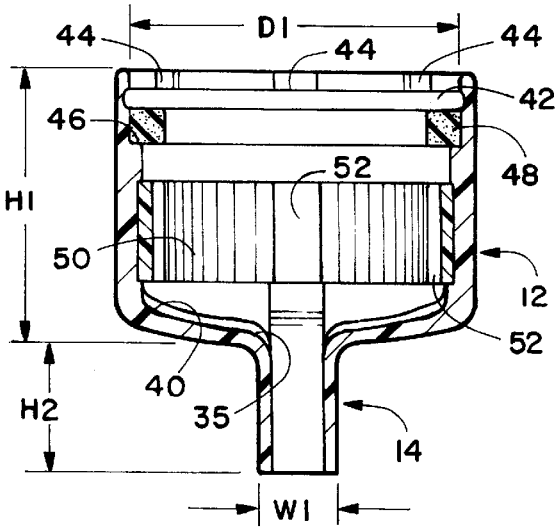
FIG. 3 is a vertical cross sectional view of the combination cap and dispensing cap assembly.

Referring to FIG. 2, the cross sectional view shows carbonated beverage bottle 16 in two distinct positions. The right half of FIG. 2 shows bottle cap 22 in its fully tightened position. The left half of FIG. 2 shows bottle cap 22 after it has been rotated ¼–¾ turn. This allows the carbonated beverage within bottle 16 to travel upward along its external threads and the interior threads of bottle cap 22. As it reaches chamber 60, the beverage can travel downwardly through axial grooves 52 and along radial grooves 40 and exit outlet port 35 downwardly through tubular spout 14.

With bottle 16 it its upright position continued rotation of tubular body 12 will lift and disengage annular groove 42 upwardly and away from annular collar 20 and make the combination cap and dispensing spout assembly removable from the top end of beverage bottle 16.

What is claimed is:

1. A combination cap and dispensing spout assembly for a carbonated beverage bottle comprising:

an elongated tubular body having a top end, a bottom end, an outer surface, an inner surface, a height H1 and an inner diameter D1; a top wall is connected to said top end of said tubular body and (it) said top wall has an outlet port and an inner surface;

sealing means adjacent said bottom end of said tubular body for providing a fluid-tight seal between the bottom end of said tubular body and an annular shoulder adjacent the top end of the neck of a plastic carbonated beverage bottle;

gripping means on said inner surface of said tubular body for gripping a knurled annular outer surface of a cap of a plastic carbonated beverage bottle so (they) said tubular body and the cap can be rotated as a single unit; and fluid passage means for allowing a carbonated beverage to flow between said gripping means on said inner surface of said tubular body and (an) the outer surface of (a) the cap of (a) the plastic carbonated beverage bottle upon which said combination cap and dispensing spout has been engaged.

2. A combination cap and dispensing spout assembly as recited in claim 1 wherein said sealing means is an annular gasket that is positioned on an annular shoulder formed on said inner surface of said tubular body adjacent its bottom end.

3. A combination cap and dispensing spout assembly as recited in claim 1 wherein said gripping means are knurled axial ridges around said inner surface of said tubular body.

4. A combination cap and dispensing spout assembly as recited in claim 3 wherein said fluid passage means are a plurality of axial grooves on said inner surface of said tubular body.

5. A combination cap and dispensing spout assembly as recited in claim 1 further comprising knurled axial ridges on said outer surface of said tubular body to provide a positive gripping surface.

6. A combination cap and dispensing spout assembly as recited in claim 1 further comprising a tubular spout having a top edge and a bottom edge; said bottom edge being connected to said outlet port of said top wall of said tubular body.

7. A combination cap and dispensing spout assembly as recited in claim 1 wherein said tubular body is made of plastic material.

8. A combination cap and dispensing spout assembly as recited in claim 1 further comprising a plurality of radial grooves on said inner surface of said top wall of said tubular body and said radial grooves are connected to said outlet port of said top wall.

9. A combination cap and dispensing spout assembly as recited in claim 1 wherein H1 is in the range of ½" to 2".

10. A combination cap and dispensing spout assembly as recited in claim 1 wherein H2 is in the range of ⅛–2".

* * * * *